United States Patent [19]

Sando et al.

[11] Patent Number: 4,742,589

[45] Date of Patent: May 10, 1988

[54] METHOD FOR CONTINUOUS LIQUID TREATMENT OF A CLOTH

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 887,993

[22] Filed: Jul. 18, 1986

[30] Foreign Application Priority Data

Jul. 22, 1985 [JP] Japan ..... 60-161670
Jul. 22, 1985 [JP] Japan ..... 60-161671

[51] Int. Cl.[4] ..... D06M 1/24; D06M 1/22

[52] U.S. Cl. ..... 8/151; 8/147; 8/148; 8/125

[58] Field of Search ..... 8/147, 148, 149.1, 149.2, 8/149.3, 150, 151, 125, 127

[56] References Cited

U.S. PATENT DOCUMENTS 3,730,679 5/1973 Schuierer ..... 8/151
4,022,574 5/1977 Ichihara ..... 8/151 X

*Primary Examiner*—Donald Watkins
*Attorney, Agent, or Firm*—Toren, McGeady & Associates

[57] ABSTRACT

A method for continuous liquid treatment of a cloth comprising transporting a cloth soaked with a treating solution continuously under width expansion by the use of a tenter while subjecting the cloth successively to wet heat treatment by jetting high temperature hot water thereto and drying the resultant cloth by jetting hot blast thereto. Under certain circumstances, it is preferably to swell the cloth by applying high temperature hot water thereto after the cloth is soaked with the treating solution for expanding width of the cloth and/or to dry the cloth tentatively before the wet heat treatment thereof for preventing the peeling off of the treating agent applied to the cloth.

4 Claims, 2 Drawing Sheets

METHOD FOR CONTINUOUS LIQUID TREATMENT OF A CLOTH

BACKGROUND OF THE INVENTION

1. Field of the Invention

The present invention relates to a method for continuous liquid treatment of a cloth, by which such treatments as pretreatment, dyeing, weight reduction, resin finish and setting (hereinafter will be called dyeing and resin finish) can be done continuously and speedily, by the use of a tenter for transporting a long cloth continuously while broadening or expanding the cloth in its width direction due to the effect of the tenter and applying high temperature hot water to the cloth by jetting hot water thereto.

2. Description of the Prior Arts

For subjecting a long cloth commercially produced to such treatments as dyeing and resin finish continuously by the use of a wet heat reaction, the use of such apparatuses as "Perble Range" (commercial name by Sando Iron Works Co., Ltd.) developed by the present inventors or a high pressure steamer has been proposed. However, Perble Range is mainly used for the pretreatment of a cloth and not suited for the use of such treatments as dyeing and resin finish. It is rather impossible to apply Perble Range for such treatments. When using Perble Range, a cloth fed therein is wet heat treated successively in batches in the folded and piled state, so that almost no tension is applied in the lengthwise direction of the cloth. Therefore, a cloth can be made shrinkable, but there occur such shortcomings as formation of creases and occurrence of unevenness at the bent parts because the cloth is treated in the folded state, and accordingly no satisfactory treatment can be made by using Perble Range. When further subjecting a cloth pretreated by the use of Perble Range to such treatments as dyeing and resin finish, the cloth should be treated by a different apparatus, necessitating many processes and a long period of time until a series of the treatments is finished. On the other hand, in the case of using a high pressure steamer, a long cloth is transported by the use of a plurality of guide rolls, so that it is possible to decrease the occurrence of creases and unevenness in the treatment. However, the cloth guided by means of a plurality of guide rolls is transported through the steamer body zigzag forming snaky undulations, so that a tension is caused to occur unavoidably in the longitudinal direction of the cloth, causing irregularity in the dimension of the cloth in its width direction. Thus, a cloth with an accurate size can hardly be produced when using a high pressure steamer.

SUMMARY OF THE INVENTION

To solve the above-mentioned problems the object of the present invention is to provide an improved method for continuous liquid treatment of a cloth under ordinary atmospheric pressure by the use of a single and cheap apparatus in subjecting the cloth to such treatments as dyeing and resin finish for speedily producing a product of an excellent quality.

The gist of the present invention is to continuously transport a cloth soaked with a treating solution while broadening the cloth in its width direction by the use of a tenter and subjecting the cloth successively to wet heat treatment and drying while the cloth is transported. According to the nature of the treatment, it is preferable to swell the cloth before the cloth is transported for facilitating the broadening of the cloth and/or to dry the cloth tentatively before the wet heat treatment thereof for preventing the peeling off of the treating agent applied to the cloth.

DETAILED DESCRIPTION OF THE PREFERRED EMBODIMENTS

The present invention will be described in detail with reference to the drawings showing the examples of the apparatus according to the present invention.

Figure 1:
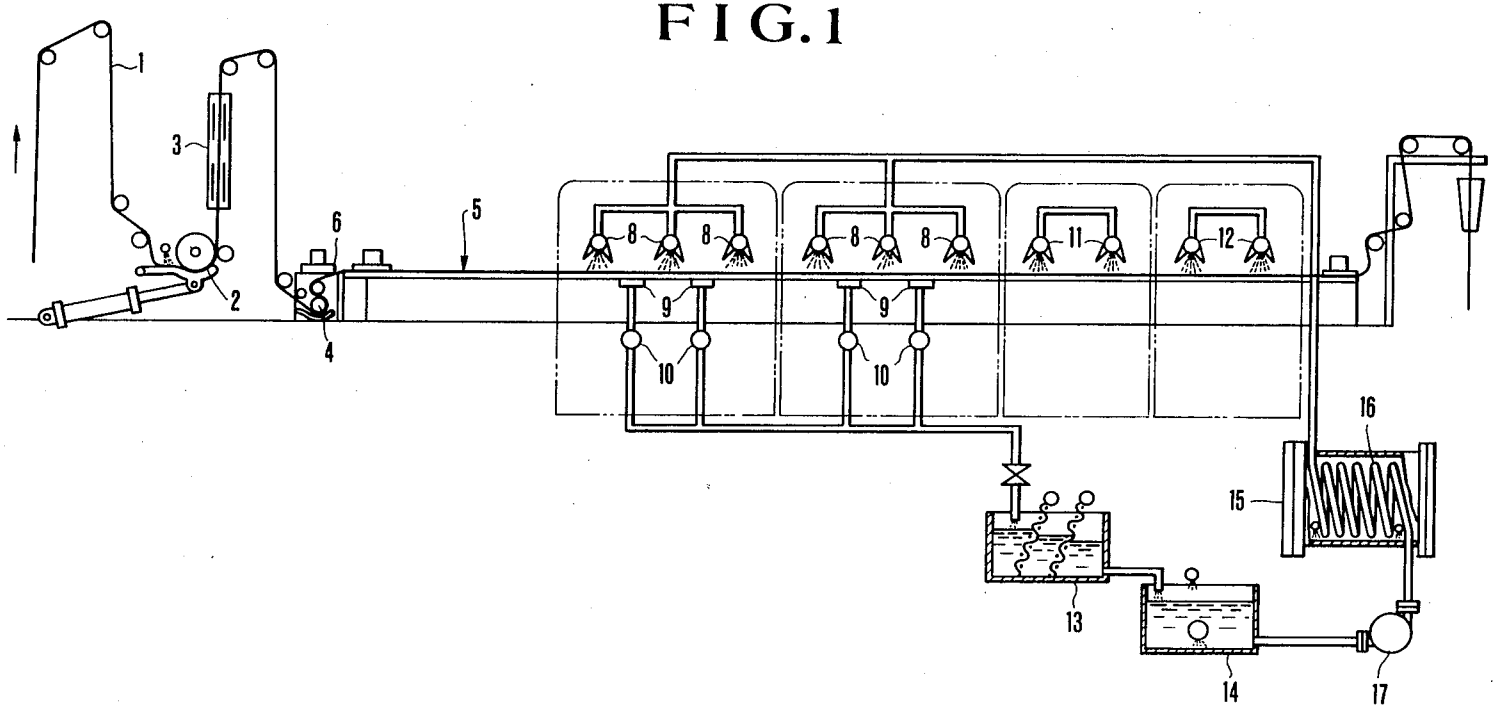
FIGS. 1 and 2, show the examples of the apparatus for the continuous liquid treatment of a cloth according to the present invention.

The apparatus shown in FIG. 1 is suitable for subjecting a cloth to dyeing followed by setting and drying in series by the use of a single apparatus. In the drawing, 1 is a cloth to be treated, 2 is a treating solution tank in which a treating solution, for instance a dye solution, to be used for the treatment is introduced, 3 is an intermediate drier by the use of infrared rays for fixing the treating agent applied to the cloth tentatively, and 4 is a feed roll for feeding the cloth to a tenter 5. The tenter 5 transports the cloth 1 while clipping both edges thereof for giving tension to the cloth in its width direction in order to expand the width of the cloth. A tenter with a known construction may suitably be applied. 6 is a hot water tank surrounding the feed roll 4 for supplying hot water to the cloth 1 for the purpose of swelling the cloth immediately before the cloth is supplied to the tenter 5 in order to facilitate the width expansion of the cloth by the operation of the tenter 5. 8 represents a plurality of hot water jet nozzles for jetting high temperature hot water to the cloth 1 passing under tension by means of the tenter 5 from the upper side thereof, and 9 represents a group of suction means provided at the lower side of the cloth for recovering hot water applied to the cloth by suction, and 10 represents suction pumps therefor. While the hot water jet nozzles 8 are divided into two groups in this example, the number of groups may be selected suitably according to circumstances, and hot water supply and steaming may also be separated. 11 represents a group of hot blast jet nozzles for jetting hot blast to the cloth 1 provided in succession to the group of hot water jet nozzles 8 for the purpose of drying the cloth, and 12 represents a group of cold blast jet nozzles provided in succession to the hot blast jet nozzles 11 for cooling the cloth thus treated. It is so designed that water recovered by the use of the suction pumps 10 is introduced in a storage tank 14 through a filter 13. 15 is a pressure vessel for the purpose of maintaining the interior thereof with a high temperature atmosphere, for instance at about 180° C., by introducing high pressure steam therein, and 16 is a hose provided in the interior of the pressure vessel 15. By supplying hot water from the storage tank 14 to the hose 16 by means of a pump 17, the temperature of water therein is heated nearly to a temperature about 180° C. for jetting the hot water to the cloth by means of the jet nozzles 8.

Now, the function of the apparatus mentioned above will be explained in the case of dyeing a cloth. When supplying a cloth 1 fixed tentatively with a dye solution into the hot water tank 6 containing hot water, the swellability of the cloth is elevated, and the thus swelled cloth is transported immediately thereafter by means of the tenter 5 by applying tension in its width direction. Thus, the transportation of the cloth while being expanded in width can effectively be done without difficulty. While the transportation of the cloth is made in this way, hot water is jetted to the cloth at a temperature, for instance, about 180° C. from a group of hot water jet nozzles 8 so that the fibers are swelled due to jetting of hot water, and due to the swelling action the dye fixed tentatively on the surface of the cloth is permeated up to the core part of the cloth and fixed firmly all over the cloth, and the cloth is set at the same time. While hot water jetted from the nozzles 8 has been heated up to about 180° C., the water is partially evaporated immediately after it is jetted from the nozzles, and its temperature is lowered suddenly. Therefore, it is preferable to narrow the distance between the jet nozzles 8 and the cloth 1 in order to apply positively high temperature water to the cloth. On the other hand, however, it is advisable that the amount of vapor to be applied to the cloth is increased by broadening the distance between the jet nozzles and the cloth in order to increase the effect of steaming. Accordingly, it is desirable to control the distance according to circumstances. The cloth dyed and set in this way due to the effect of wet heat treatment by means of hot water and/or steam jetted from the hot water jet nozzles 8 is sent to the drying zone, and dried by means of hot blast jetted from the hot blast jet nozzles 11. The thus dried cloth is then cooled by means of the cold blast jetted from the cold blast jet nozzles 12, and transported to the following processes by leaving the tenter 5.

As described above, in this example, since high temperature water is applied to the cloth immediately before the cloth is supplied to the tenter, the cloth is swelled sufficiently before the tenter, and accordingly, the cloth can be transported through the tenter smoothly under tension in its width direction by the effect of the tenter. The cloth is wet heat treated by applying hot water at a temperature about 180° C. thereto, and then subjected to drying and cooling processes in succession. Therefore, dyeing, setting and drying of a long cloth can smoothly and continuously be done in series by the use of a single tenter to produce effectively a cloth with uniform and excellent quality.

While dyeing of a cloth has been explained above, such treatments as pretreatment and weight reduction of a cloth can similarly be done by using the apparatus in this example. In pretreatment and weight reduction of a cloth, a caustic alkali solution is applied. In such instances, the cloth is not contacted with air from the wet heat treatment until cooling, so that the danger of oxidation of the cloth can perfectly be prevented.

Figure 2:
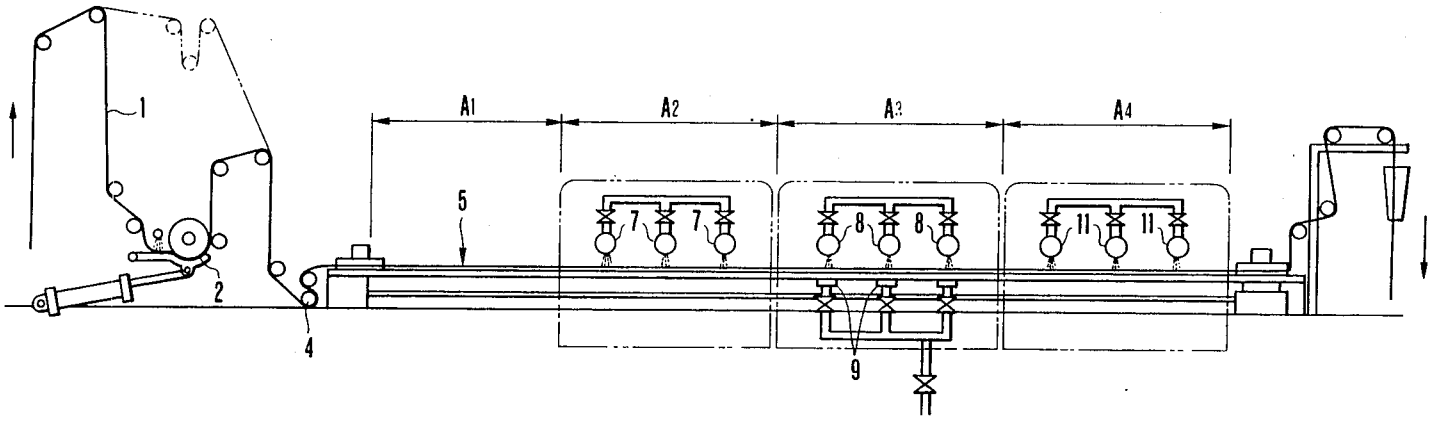

Another example of the apparatus according to the present invention will be described hereinbelow with reference to FIG. 2. This apparatus is suitable for subjecting a cloth particularly to resin finish, in which resin finish, setting and drying of a cloth can suitably be done in series by the use of a single apparatus. In this example, a cloth 1 to be treated coming out of the treating solution tank 2 is supplied directly to a tenter through a feed roll 4 with no application of an intermediate drier and a hot water tank. The total length of the tenter 5 from the inlet of the cloth to the outlet thereof may be divided into four zones, a tentering zone A1, a preliminary drying zone A2, a wet heat treating zone A3 and a drying zone A4 in series. In the preliminary drying zone A2, a plurality of dry hot blast jet nozzles 7 are provided for jetting low-pressure hot blast to the cloth. In the wet heat treating zone A3, a group of hot water jet nozzles 8 are provided for jetting high temperature water, for instance at a temperature about 180° C., to the cloth from the upper surface thereof together with a group of suction means 9 close to the lower surface of the cloth for recovering hot water from the cloth. Finally, in the drying zone A4, a group of hot blast jet nozzles are provided for jetting dry hot blast to the cloth for drying the cloth.

The operation of this apparatus in subjecting a cloth to resin finish will be explained as follows. In this case, a cloth soaked with a resin solution in the treating solution tank 2 is guided directly through the feed roll 4 to the tenter 5. The cloth swelled to some extent by soaking with the resin solution is transported under width expansion by clamping both selvage parts of the cloth. The cloth is tentered to a prescribed width while the cloth is passing through the tentering zone A1, then the resin is fixed tentatively to the cloth due to the effect of hot blast, for instance at a temperature of 70° to 80° C., jetted from the dry hot blast jetting nozzles 7 while the cloth is passing through the preliminary drying zone A2, and the peeling off of the resin is prevented completely by jetting high temperature blast, for instance at a temperature about 180° C., as in the preceding case while the cloth is passing through the wet heat treating zone A3. The thus treated cloth is finally dried by passing through the drying zone A4, and the resin finish of a cloth can eminently be completed by using the apparatus in this example.

As described above, the method for continuous liquid treatment of a cloth according to the present invention enables it to transport a cloth to be treated under width expansion easily by a single tenter. The method is quite suitable for the continuous treatment of a cloth such as dyeing and resin finish under an ordinary atmospheric pressure together with its setting and drying after the treatment. Since the treatment is done by the use of a single apparatus continuously, it is possible to produce a uniform and excellent product. Furthermore, since the construction of the apparatus is very simple when used at an ordinary atmospheric pressure, the production cost can remarkably be reduced. Thus, the effect of the present invention is quite distinguished, and the method is particularly suitable for mass-production.

What is claimed is:

1. A method for continuous liquid treatment of a cloth comprising transporting a cloth soaked with a treating solution continuously and tentering the cloth for expanding the width thereof and while tentering subjecting the cloth successively to wet heat treatment by jetting high temperature hot water at a temperature about 180° C. thereto and then drying the resultant cloth by jetting hot blast thereto.

2. A method according to claim 1, in which before subjecting the cloth to tentering the cloth is swelled by applying high temperature hot water thereto after the cloth is soaked with the treating solution for expanding width of the cloth.

3. A method according to claim 1, in which during tentering the cloth is tentatively dried before the wet heat treatment thereof for preventing the peeling off of the treating agent applied to the cloth.

4. A method according to claim 2, in which during tentering the cloth is tentatively dried before the wet heat treatment thereof for preventing the peeling off of the treating agent applied to the cloth.

* * * * *